US008176662B2

(12) United States Patent
Peterson

(10) Patent No.: US 8,176,662 B2
(45) Date of Patent: May 15, 2012

(54) DIGGING SYSTEM AND METHOD

(76) Inventor: Larry William Peterson, Moline, IL (US)

( * ) Notice: Subject to any disclaimer, the term of this patent is extended or adjusted under 35 U.S.C. 154(b) by 0 days.

(21) Appl. No.: 12/817,509

(22) Filed: Jun. 17, 2010

(65) Prior Publication Data

US 2011/0308116 A1 Dec. 22, 2011

(51) Int. Cl.
*E02F 5/06* (2006.01)

(52) U.S. Cl. ..... 37/360; 37/352; 37/356; 37/365; 37/238; 37/403; 37/462; 299/34.01

(58) Field of Classification Search ..... 37/360, 37/352, 355–357, 365, 238, 241, 242, 403, 37/462–464, 349; 299/34.01, 34.02
See application file for complete search history.

(56) References Cited

U.S. PATENT DOCUMENTS

| | | | | | |
|---|---|---|---|---|---|
| 264,062 | A | | 9/1882 | Bonnell | |
| 717,530 | A | | 1/1903 | Bentson | |
| 1,477,940 | A | * | 12/1923 | Brown | 37/356 |
| 1,519,897 | A | * | 12/1924 | Asplund | 37/357 |
| 1,684,869 | A | * | 9/1928 | Krueger | 299/9 |
| 1,740,923 | A | * | 12/1929 | Jaeger | 37/357 |
| 1,777,439 | A | * | 10/1930 | Lamont | 37/356 |
| 1,856,216 | A | * | 5/1932 | Jaeger | 37/357 |
| 2,519,077 | A | * | 8/1950 | Schmidt | 37/352 |
| 2,842,873 | A | * | 7/1958 | George et al. | 37/352 |
| 3,057,089 | A | * | 10/1962 | Kiechel et al. | 37/352 |
| 3,308,563 | A | * | 3/1967 | Danek | 37/228 |
| 3,318,638 | A | * | 5/1967 | Kilbourne | 299/76 |
| 3,540,139 | A | * | 11/1970 | Dye et al. | 37/357 |
| 3,614,162 | A | * | 10/1971 | Teeter | 299/67 |
| 3,730,593 | A | * | 5/1973 | Karlovsky, Jr. | 299/76 |
| 3,896,570 | A | * | 7/1975 | McMurray | 37/357 |
| 3,951,459 | A | * | 4/1976 | Honeycutt, Jr. | 299/11 |
| 3,986,280 | A | * | 10/1976 | Johnson | 37/349 |
| 4,483,084 | A | * | 11/1984 | Caldwell et al. | 37/349 |
| 4,656,762 | A | * | 4/1987 | Schliehe | 37/238 |
| 4,742,627 | A | * | 5/1988 | Lindstrom | 37/352 |
| 4,755,001 | A | * | 7/1988 | Gilbert | 299/39.8 |
| 4,794,708 | A | * | 1/1989 | Schroeder et al. | 37/352 |
| 4,827,636 | A | * | 5/1989 | Emming | 37/349 |
| 4,981,396 | A | * | 1/1991 | Albertson et al. | 405/178 |
| 5,189,817 | A | * | 3/1993 | Schroeder | 37/349 |
| 5,228,220 | A | * | 7/1993 | Bryan, Jr. | 37/364 |
| 5,228,221 | A | * | 7/1993 | Hillard et al. | 37/355 |
| 5,497,567 | A | * | 3/1996 | Gilbert | 37/352 |
| 6,470,607 | B1 | | 10/2002 | Taki | |
| 6,658,767 | B2 | * | 12/2003 | Kelly et al. | 37/347 |
| 2009/0260264 | A1 | * | 10/2009 | Cooper et al. | 37/195 |

FOREIGN PATENT DOCUMENTS

| | | |
|---|---|---|
| WO | WO9721877 | 6/1997 |

* cited by examiner

*Primary Examiner* — Thomas Beach
*Assistant Examiner* — Matthew Buck

(57) ABSTRACT

A digging system includes a machine having a machine frame, and an implement assembly mounted to the machine frame. The implement assembly includes an elongate boom and a trenching mechanism having a plurality of drawing cutters coupled with an endless drive chain movable about a drive system mounted to an elongate boom. The implement assembly further includes an undercutting mechanism having first and second rotating cutters projecting in opposite axial directions from the distal boom end. The implement assembly defines a compound projection profile in a plane which includes first and second axes of rotation of a drive wheel and guide wheel of the drive system. The compound projection profile includes a relatively narrow proximal stem segment corresponding to the trenching mechanism and a relatively broad distal footing segment corresponding to the undercutting mechanism. Actuating the trenching mechanism and undercutting mechanism enables simultaneously digging a stem segment and footing segment of a compound trench for a foundation system.

17 Claims, 3 Drawing Sheets

DIGGING SYSTEM AND METHOD

TECHNICAL FIELD

The present disclosure relates generally to machine digging systems and strategies, and relates more particularly to simultaneously digging a narrow proximal stem segment and a broad distal footing segment of a compound trench for a foundation system.

BACKGROUND

Machines and systems for digging trenches are an ancient form of technology. Persons involved in the construction of buildings and other civil engineering projects recognized literally centuries ago the value in reducing the back breaking labor associated with forming trenches in soil, gravel, and other types of materials. Many different types of animal and steam powered systems were proposed long ago to assist in elevating material from the floor of a trench to reduce the need for, and risks associated with, manual labor. In more recent times, increasingly sophisticated hydraulically and pneumatically powered mechanisms have been developed.

Trenching systems from approximately the middle to the latter part of the twentieth century were often designed to provide a tremendous amount of brute force for cutting through and displacing large volumes of material in a relatively short amount of time. Backhoes and other types of heavy equipment commonly seen at construction sites are a familiar example of systems available to contractors for relatively rapid and effective displacement of large volumes of material for forming all manner of trenches. The formation of trenches for utility pipes or lines, and for the subsurface preparation of building foundation systems are common instances where such heavy equipment is used.

Despite advances in trenching equipment technology and the wide availability of different trench forming attachments in recent decades, there remains room for improvement. The "brute force" approaches discussed above are well suited for moving a large amount of material relatively quickly. Once a relatively large trench is roughly prepared, however, extensive manual and/or mechanized post-digging steps are often necessary before the trench is made suitable for its intended purposes. A more refined approach is thus desirable in some instances, which would reduce the necessary post-digging activities.

One instance where a more elegant approach is desirable relates to the preparation of trenches for building foundation systems in which a compound footing and stem wall structure is to be built. Such foundation systems are often best designed with a relatively narrow poured concrete stem segment which transitions to a relatively broad footing segment. The footing segment may include a horizontally extending body of poured concrete, positioned below the ground surface typically below the frost line. The stem segment is typically a vertically extending poured concrete body which is continuous with the footing segment and projects upwardly toward and beyond the ground surface to provide a monolithic support upon which a structure may be built.

Probably the most common approach to preparing a trench for pouring of a monolithic compound concrete footing is to dig an overly large trench, and then build concrete forms within the trench, pour the concrete, remove the forms and then back-fill soil, etc. around the vertically extending stem portion of the monolithic concrete and over the footing section. The extensive manual labor required to perform such procedures needs no further explanation. Various designs have been proposed over the years for digging a footing trench having a suitable cross sectional shape such that form building and backfilling are not necessary. Such systems, however, tend to be relatively complex and certainly quite expensive.

The present disclosure is directed to one or more of the problems or shortcomings set forth above.

SUMMARY OF THE DISCLOSURE

In one aspect, a digging system includes a machine having a machine frame, ground engaging propulsion elements coupled with the machine frame, and a motor mounted to the machine frame and having a motor output shaft. The digging system further includes an implement assembly including an elongate boom having a proximal boom end pivotably coupled with the machine frame, a distal boom end, and a drive system having a drive wheel coupled with the motor output shaft and being positioned adjacent the proximal boom end, and a guide wheel mounted to the distal boom end. The drive wheel defines a first axis of rotation and the guide wheel defines a second axis of rotation. The implement assembly further includes a trenching mechanism having a plurality of drawing cutters coupled with an endless drive chain contacting and movable about each of the drive wheel and the guide wheel. The implement assembly further includes an undercutting mechanism mounted to the distal boom end and having a first rotating cutter projecting in a first axial direction form the distal boom end, and a second rotating cutter projecting in a second axial direction from the distal boom end. The first axis of rotation and the second axis of rotation define a plane, and the implement assembly further defines a compound projection profile in the plane. The compound projection profile includes a proximal stem segment corresponding to the trenching mechanism, and a distal footing segment corresponding to the under cutting mechanism and adjoining the proximal stem segment. The proximal stem segment includes a relatively narrow segment width defined by outboard edges of the drawing cutters, and the distal footing segment includes a relatively broad segment width defined by outboard ends of the first and second rotating cutters.

In another aspect, a method of preparing a foundation system includes actuating a trenching mechanism of a digging system at least in part by moving a plurality of drawing cutters coupled with an endless drive chain about a proximal drive wheel and a distal guide wheel mounted to an elongate boom of an implement assembly. The method further includes actuating an undercutting mechanism of the digging system at least in part by rotating a plurality of rotatable cutters projecting in opposite axial directions from a distal end of the elongate boom, during actuating the trenching mechanism. The method further includes simultaneously digging a narrow proximal stem segment and a broad distal footing segment of a compound trench at least in part by actuating the trenching mechanism and actuating the undercutting mechanism.

DETAILED DESCRIPTION

Figure 1:
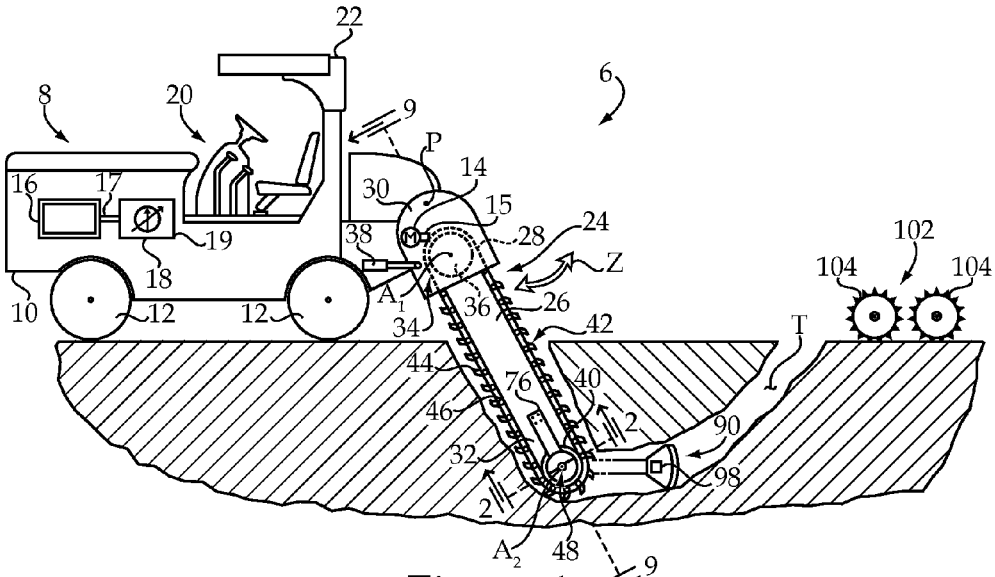
FIG. 1 is a side diagrammatic view of a digging system according to one embodiment.

Referring to FIG. 1, there is shown a digging system 6 according to one embodiment. Digging system 6 may include a machine 8 having a machine frame 10, ground engaging propulsion elements coupled with frame 10, and an engine such as an internal combustion diesel engine 16 mounted to frame 10 and configured to provide power to propulsion elements 12. In the illustrated embodiment, propulsion elements 12 are shown as wheels, however, in other embodiments tracks might be used. Engine 16 may include an output shaft 17 configured to power a hydraulic system 18 having a hydraulic pump 19. Pump 19 may include a variable displacement pump in one embodiment. Hydraulic system 18 may also include a hydraulic motor 14 mounted to frame 10 and having a motor output shaft 15. Hydraulic system 18 may further include one or more linear hydraulic actuators 38 configured to raise, lower or laterally swing an implement assembly 24. Machine 8 may further include an operator station 20 having various operator controls for monitoring and/or controlling operation of machine 8, as further described herein. A protective structure 22 such as a rollover protective structure may be mounted to frame 10. As will be further apparent from the following description, digging system 6 may be uniquely configured to enable the preparation of foundation systems by digging a compound trench.

Implement assembly 24 may include an elongate boom 26 having a proximal boom end 28 pivotably coupled with frame 10 and configured to pivot in a vertical direction about a pivot axis P. A side to side pivot axis may also be provided between implement assembly 24 and frame 10 and lies within the plane of the page in FIG. 1. Boom 26 may further include a distal boom end 32. A housing or the like 30 may be provided which covers and protects certain components of implement assembly 24 near proximal boom end 28. Implement assembly 24 may further include a drive system 34 having a drive wheel 36 coupled with motor output shaft 15 and being positioned adjacent boom end 28. Drive system 34 may further include a guide wheel 40 mounted to distal boom end 32. Drive wheel 36 defines a first axis of rotation $A_1$, and guide wheel 40 defines a second axis of rotation $A_2$.

Implement assembly 24 may further include a trenching mechanism 42 having a plurality of drawing cutters 44 coupled with an endless drive chain 46 contacting and movable about each of drive wheel 36 and guide wheel 40. Implement assembly 24 may also include an undercutting mechanism 48 mounted to distal boom end 32 and having a first rotating cutter projecting in a first axial direction from boom end 32, and a second rotating cutter projecting in a second, opposite axial direction from boom end 32. Example features of the rotating cutters are further described below.

Digging system 6 may further include a material directing drag mechanism 90, coupled with implement assembly 24 when implement assembly 24 is in an assembly configuration as shown in FIG. 1. System 6 may also include a finishing mechanism 102 having first and second rotatable drums 104 swappable with the first and second rotating cutters to place implement assembly 24 in a second assembly configuration. In the second assembly configuration, drag mechanism 90 may be decoupled from implement assembly 24.

Figure 2:
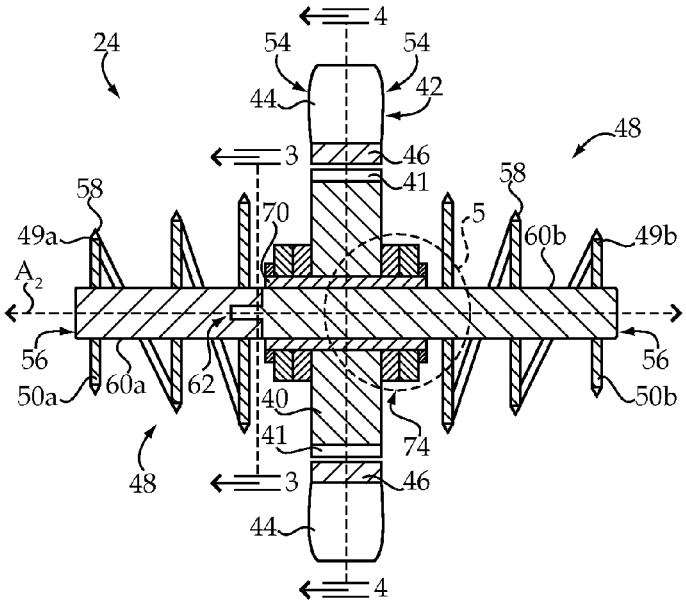
FIG. 2 is a sectioned view taken along line 2-2 of FIG. 1.

Referring also to FIG. 2 there is shown a portion of trenching mechanism 42, and undercutting mechanism 48 in more detail. As noted above, undercutting mechanism 48 may include a first rotating cutter 50*a* and a second rotating cutter 50*b*. Cutters 50*a* and 50*b* may taper in diameter from a narrower diameter at axially outward locations to a broader diameter at axially inward locations. In one embodiment, rotating cutters 50*a* and 50*b* may include first and second co-rotating augurs. The first and second co-rotating augurs may include a left-handed augur and a right-handed augur, each of which may be fixed to rotate with guide wheel 40. First rotating cutter 50*a* may include a blade 49*a* having a plurality of cutting teeth 58 mounted thereon. Blade 49*a* may include a generally spiraling configuration about a shaft 60*a* in the illustrated embodiment. When rotating cutter 50*a* is viewed end-on towards an outboard end 56 thereof, blade 49*a* would be perceived to spiral counterclockwise in an axially inward direction towards guide wheel 40. Hence, rotating cutter 50*a* may include a left-handed auger. Rotating cutter 50*b* may also include a blade 49*b* having teeth 58 mounted thereon. Blade 49*b* may include a spiraling configuration which is the opposite of that associated with rotating cutter 50*a*, and thus may include a right-handed auger. In one embodiment, undercutting mechanism 48 may include a total of two rotating cutters, comprising a total of two co-rotating augers.

Figure 9:
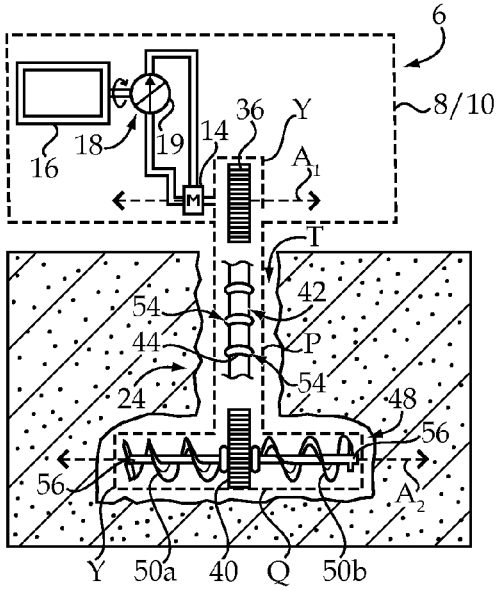
FIG. 9 is a diagrammatic fragmentary view taken along line 9-9 of FIG. 1.

Referring now also to FIG. 9, there is shown a view of digging system 6 taken along line 9-9 of FIG. 1. Digging system 6 is shown as it might appear where implement assembly 24 is positioned within a trench T and is digging trench T by actuating trenching mechanism 42 and activating undercutting mechanism 48. Axis of rotation $A_1$ and axis of rotation $A_2$ may define a plane, corresponding to the plane of the page in FIG. 9, and implement assembly 24 may define a compound projection profile in the plane. The compound projection profile is denoted with reference letter Y in FIG. 9, and includes a proximal stem segment P corresponding to trenching mechanism 42, and a distal footing segment Q corresponding to undercutting mechanism 48. Proximal stem segment P may include a relatively narrow segment width defined by outboard edges 54 of drawing cutters 44, whereas distal footing segment Q may include a relatively broad segment width defined by outboard ends 56 of first and second rotating cutters 50*a* and 50*b*. As further described herein, designing digging system 6 such that implement assembly 24 has a configuration in space which defines a compound projection profile approximately as shown enables simultaneously digging proximal stem segment P and distal footing segment Q by actuating trenching mechanism 42 and actuating undercutting mechanism 48.

Returning to FIG. 2, it will be recalled that rotating cutter 50*a* includes a shaft 60*a*. Cutter 50*b* may likewise include a shaft 60*b*. An assembly of shaft 60*a* and 60*b* may be coaxial with guide wheel 40, and shaft 60*b* may include an axial shaft length which is greater than an axial shaft length of shaft 60*a*. Implement assembly 24 may further include a mechanism for coupling together shafts 60*a* and 60*b* and inhibiting relative rotation between the respective shafts. To this end, a key mechanism 62 may be provided which allows shafts 60*a* and 60*b* to be locked together.

Figure 3:
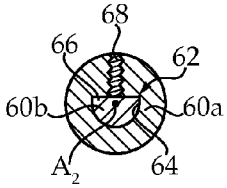
FIG. 3 is a sectioned view taken along line 3-3 of FIG. 2.

Referring to FIG. 3, there is shown a sectioned view taken along line 3-3 of FIG. 2. Key mechanism 62 may comprise a stub shaft 64 which includes an extension of shaft 60*b*, received in a complementary shaped bore 66 defined by shaft 60*a*. It may be noted that stub shaft 64 and bore 66 include non-circular cross sectional shapes. A set screw 68 or the like may be threadedly received through shaft 60*a* and contacts stub shaft 60*b*, for example, to lock shafts 60*a* and 60*b* together and prevent axial separation thereof during operation. A wide variety of other mechanisms might be used to couple together shafts 60*a* and 60*b*, and the present disclosure is not limited to any particular strategy. For example, one of shafts 60*a* and 60*b* might be screwed into the other shaft. Further still, rather than using two separate shafts, blades 49*a* or 49*b* might be mounted on and configured to be decoupled from a common shaft, allowing the common shaft to be removed from implement assembly 24 when blades 49*a* and 49*b* are detached.

Figure 4:
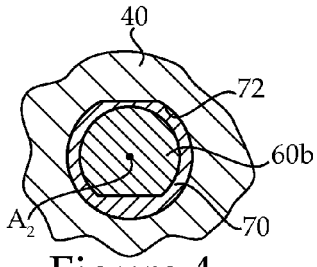
FIG. 4 is a sectioned view taken along line 4-4 of FIG. 2.

Referring now to FIG. 4, there is shown a sectioned view through implement assembly 24 taken along line 4-4 FIG. 2. In one embodiment, shaft 60*b* may pass axially through guide wheel 40 and be mounted therein within a sleeve 70. Sleeve 70 may include a non-circular inner diameter shape as shown in FIG. 4, and shaft 60*b* may include a complementary, non-circular outer diameter shape, such that relative rotation between shaft 60*b* and sleeve 70 is inhibited. In an analogous manner, sleeve 70 may be received in a bore 72 in drive wheel 40 which also includes a non-circular shape, complementary to a non-circular outer diameter shape of sleeve 70 to inhibit relative rotation among sleeve 70 and shaft 60*b*. Guide wheel 40, sleeve 70, shaft 60*a* and shaft 60*b* may all be coaxially arranged. Analogous to the foregoing description of key mechanism 62, a variety of geometric shapes and general assembly and coupling strategies could be used to provide the functions of inhibiting relative rotation among components.

Figure 5:
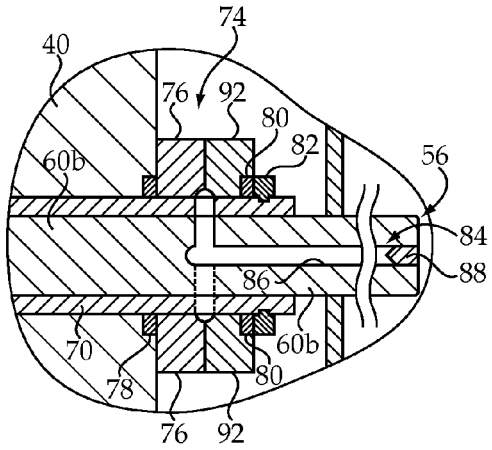
FIG. 5 is an enlarged, sectioned view of a portion of FIG. 2.

Returning to FIG. 2, implement assembly 24 may further include a mounting system 74. Mounting system 74 may be adapted to mount guide wheel 40 to boom 26 and allow rotation of guide wheel 40 relative to boom 26. Mounting system 74 may include a set of support bars 76 which are fixed to boom 26, for example welded or bolted thereto. A set of connecting arms 92, further described below, may be positioned axially outward of support bars 76. Referring also to FIG. 5, there is shown a detailed enlargement of a portion of FIG. 2. Mounting system 74 may further include a first thrust ring 78 positioned axially between each of support bars 76 and guide wheel 40. Although only one side of mounting system 74 shown in FIG. 5, it should be understood that an opposite side of mounting system 74 on an opposite side of guide wheel 40 may be similarly configured. Mounting system 74 may further include a second thrust ring 80 positioned adjacent connecting arm 92. A snap ring 82 or the like may be positioned adjacent thrust ring 80 and coupled to sleeve 70 to prevent axial separation among components 78, 76, 92 and 80. Thrust rings 78 and 80 may react axial thrust loads experienced during operating implement assembly 24.

Implement assembly 24 may further include a lubrication system 84 having, for example, an oil passage 86 formed in shaft 60*b* and configured to supply a lubricating oil or the like between and among various components of implement assembly 24, and in particular mounting system 74. Connecting arms 92 may be configured to rotate relative to support bars 76 and relative to sleeve 70, hence the desire for some means of lubricating the contacting faces of the components. A stopper 88 may be positioned within passage 86 to retain lubricating oil therein in a conventional manner.

Figure 6:
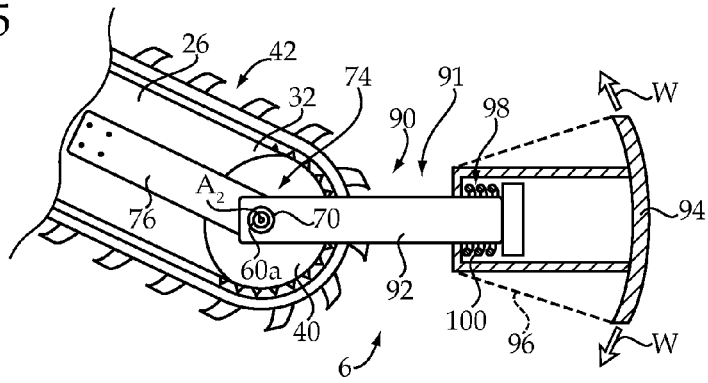
FIG. 6 is a side diagrammatic view of a portion of the digging system of FIG. 1, in a first assembly configuration.

Turning now to FIG. 6, there is shown a side diagrammatic view of a portion of digging system 6, and in particular illustrating certain example features of drag mechanism 90 in greater detail. As mentioned above, support arms 92 may be coupled with other components of implement assembly 24 by way of mounting system 74. Connecting arms 92 may extend outwardly, away from machine 10, relative to guide wheel 40. Drag mechanism 90 may further include a drag plate 94 coupled with a yoke 91. A shroud 96, shown in phantom in FIG. 6, may extend between drag plate 94 and connecting arms 92. A shock absorber 98 may be coupled between drag plate 94 and connecting arms 92 to allow relative motion of drag plate 94 towards and away from guide wheel 40 in response to loads encountered during dragging drag mechanism 90 along the floor and along the walls and ceiling of a trench. In the illustrated embodiment, shock absorber 98 includes a spring 100 which may be a conventional metallic coil spring. In other embodiments, a gas spring, elastomeric bumpers, or still another shock absorber design might be used. Drag mechanism 90 may also be pivotable about axis $A_2$ in directions shown via arrows W to enable vertical movement of drag plate 94 during operation.

Figure 7:
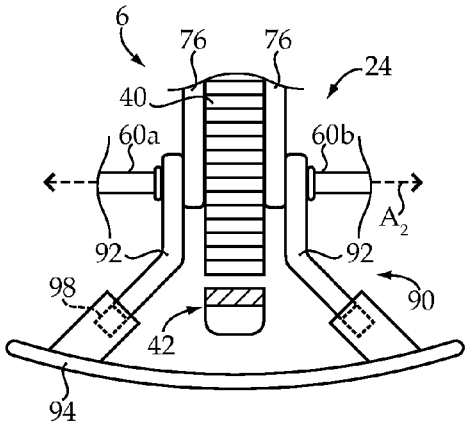
FIG. 7 is a partially sectioned top diagrammatic view of the portion of the digging system shown in FIG. 6.

Referring now to FIG. 7, there is shown a top view of drag mechanism 90, in partial cutaway. It may be noted that connecting arms 92 bend outwardly in a direction parallel axis $A_2$ between guide wheel 40 and drag plate 94. It may also be noted that drag plate 94 includes an arcuate configuration, which is contemplated to enable the directing of material towards trenching mechanism 42 during operation so that the material can be readily elevated out of a trench.

Figure 8:
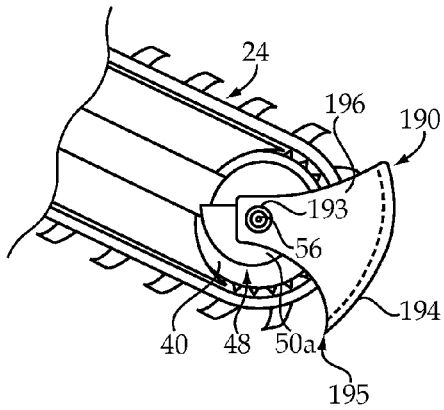
FIG. 8 is a side diagrammatic view of a portion of a digging system, according to another embodiment.

Referring to FIG. 8, there is shown a material directing drag mechanism 190 functionally similar to the embodiment described above, but having certain differences. The components of implement assembly 24 depicted in FIG. 8 may be substantially identical to those previously described, and thus are identified with identical reference numerals. Drag mechanism 190 may include a drag plate 194 or the like which includes a downwardly oriented cutting edge 195. The phantom line in FIG. 8 identifies an inside surface of plate 194. A shroud 196 extends between plate 194 and shafts 60*a*, 60*b*. Outboard end 56 of shaft 60*a* is shown in FIG. 8. Drag mechanism 190 may be coupled with implement assembly 24 by mounting shroud 196 to shafts 60*a* and 60*b*. Thus, separate connecting arms are not used, in contrast to the FIG. 7 embodiment. A snap ring 193 is shown which may be coupled with the corresponding shaft 60*a*, 60*b*, to resist decoupling shroud 196 from end(s) 56. The side of mechanism 90 which is not visible in FIG. 8 may be configured similarly to the side which is shown.

Industrial Applicability

It will be recalled that digging system 6 may be configured for preparing a foundation system such as a foundation system for a building structure or the like. As discussed above, construction engineers and builders have long been challenged by the necessity of digging overly wide trenches to accommodate poured concrete foundations. For many foundation systems, it is generally desirable to have a relatively broad footing to provide a solid and robust support system for a building structure, and also to resist forces such as freeze/thaw cycles which can cause buckling, cracking, sinkage or other problems. The state of the art has previously included relatively complex and expensive systems to dig compound trenches. Such systems have seen only limited use, and the challenges of constructing foundation systems of the types described above have more commonly been addressed by the laborious process of digging an overly broad trench, building forms within the trench and then backfilling material to eventually arrive at a foundation system having the appropriate structure.

The advantageous digging functions of the present disclosure may be performed by actuating trenching mechanism 42 via moving drawing cutters 44 coupled with chain 46 about drive wheel 36 and guide wheel 40 and actuating undercutting mechanism 48 by rotating cutters 50*a* and 50*b*. Each of mechanisms 42 and 48 may be powered via drive system 34. To this end, each of drive wheel 36 and guide wheel 40 may include a toothed gear wheel, teeth 41 of guide wheel 40 being shown in FIG. 2, for example. Teeth 41 and corresponding teeth on drive wheel 36 engage with chain 46 in a conventional manner. In one embodiment, rotation of cutters 50*a* and 50*b* may be induced by rotating guide wheel 40. In other embodiments, undercutting mechanism 48 might be equipped with its own drive mechanism, such as one or more hydraulic motors mounted to boom 26 for example, and rotatably coupled with shafts 60*a* and 60*b*. Actuating the respective trenching mechanism 42 and undercutting mechanism 48 may occur simultaneously, such that a narrow proximal stem segment and a broad distal footing segment of a compound trench such as trench T described herein may be simultaneously formed.

Figure 10:
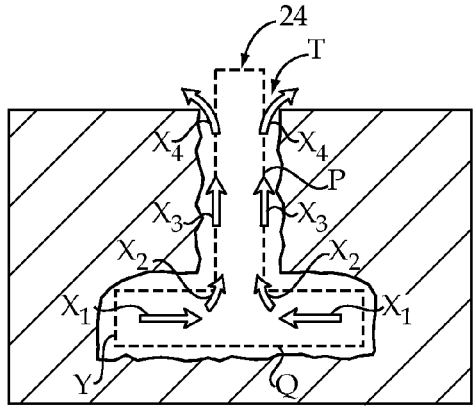
FIG. 10 is a diagrammatic view showing a compound profile defined by an implement assembly, and material feed path, according to one embodiment.

Referring to FIG. 10, there is shown a diagrammatic view of implement assembly 24, as represented by compound profile Y, positioned within trench T. FIG. 10 illustrates certain of the attributes relating to displacement of material by implement assembly 24 during digging. Arrows $X_1$ indicate an approximate direction of material displacement within the distal footing segment of trench T. It may be noted that arrows $X_1$ indicate a direction of material displacement which includes an axially inward direction. Material may be displaced during digging in the directions indicated by arrows $X_1$ by actuating undercutting mechanism 48. Arrows $X_2$ indicate an approximate material displacement direction whereby displaced material transitions from the distal footing segment to the proximal stem segment of trench T. Arrows $X_3$ indicate a vertical direction of material displacement within the stem segment which is approximately normal to an axis of rotation of guide wheel 40. Material is displaced in the vertical direction indicated by arrows $X_3$ via actuating trenching mechanism 42. Arrows $X_4$ indicate an approximate direction of material displacement as material transitions from the proximal stem segment of trench T through and past an open ceiling of trench T.

Referring also to FIG. 1, during forming compound trench T and displacing material therefrom, drag mechanism 90 may be moved along behind implement assembly 24. Drag mechanism 90 may define a drag profile in the plane of the page in FIG. 10 which is congruous with the distal footing segment of the trench. "Congruous" means that the drag profile includes a shape which is approximately congruent with a shape of segment P of profile Y. An oval drag profile would likely be considered congruous with a rectangular distal footing profile segment. In contrast, a circular or triangular drag profile would likely not be considered congruous with a rectangular distal footing profile segment. In one embodiment, the drag profile may be approximately identical to distal footing segment Q of compound projection profile Y. It may thus be understood that a direction of material displacement by drag mechanism 90 would pass into the plane of the page in FIG. 10.

Another way to understand the material displacing properties of drag mechanism 90 is that material may be displaced in a horizontal direction oriented normal to axis $A_2$ via dragging drag mechanism 90 along a floor of the distal footing segment of the trench. It may further be appreciated that pivoting of implement assembly 24 about pivot point P, and pivoting of drag mechanism 90 about axis $A_2$ can change the relationships among the "vertical," and "horizontal" directions described herein. At least some of the time, however, during operation material displaced via actuating trenching mechanism 42 will move in a direction which is closer to a vertical direction relative to a surface of the ground than it is to the horizontal ground surface. Similarly, at least some of the time material displaced by drag mechanism 90 will be displaced in a direction relatively closer to a horizontal direction, parallel the ground surface, than it is to a vertical direction normal to the ground surface. In many instances, displacing material may include feeding material from a floor of the compound trench T to an open ceiling of the compound trench according to a compound tri-directional feed path defined by the material displacement directions associated with each of trenching mechanism 42, undercutting mechanism 48, and drag mechanism 90. Drag mechanism 90 may push/pull material horizontally toward mechanism 48, mechanism 48 may push material horizontally toward mechanism 42, and mechanism 42 may elevate the material vertically out of trench T. All the while, mechanisms 42 and 48 will be cutting fresh material to form the trench.

Figure 11:
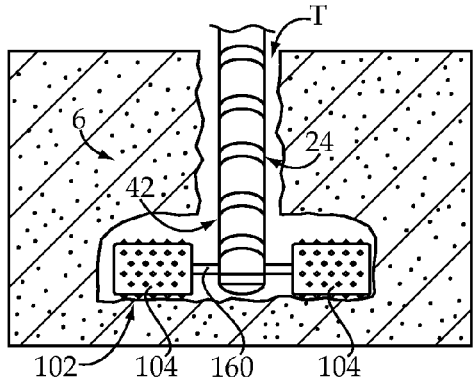
FIG. 11 is a top diagrammatic view of a portion of the digging system of FIG. 1, in a second assembly configuration.

Those skilled in the art will appreciate that an initial machine pass through a material such as soil, sand, gravel, mixtures of materials, may not necessarily result in a trench which is immediately amenable to pouring of concrete therein. This is the case whether a machine such as a trenching machine, a backhoe, or another digging system, is used. In other words, it may be desirable to perform some finishing such as compacting of the material within a trench prior to pouring concrete therein. To this end, digging trench T may include performing an initial material removal pass with digging system 6, followed by performing a subsequent material finishing pass with digging system 6. In one embodiment, the initial material removal pass may be performed with digging system 6 approximately in the assembly configuration shown in FIG. 1, with drag mechanism 90 coupled with implement assembly 24. Referring to FIG. 11, performing a subsequent material finishing pass may take place by decoupling drag mechanism 90 and also decoupling rotating cutters 50*a* and 50*b* from implement assembly 24, and then coupling finishing mechanism 102 with implement assembly 24.

In particular, rotatable drums 104 may be swapped for rotating cutters 50*a* and 50*b* in preparation for the finishing pass. Rotatable finishing drums 104 may each include spikes or some other feature on the surface thereof to assist in compacting or otherwise treating material within trench T. Drums 104 might also be equipped with a vibratory mechanism such as an internal, rotating, asymmetric mass of a type similar to that used in vibratory compactor machines. A shaft assembly 160 may be part of finishing mechanism 102 and configured similarly to the shaft assembly comprised of shafts 60*a* and 60*b* of undercutting mechanism 48. Drums 104 may be rotated in a manner similar to that of rotating cutters 50*a* and 50*b* during performing a material finishing pass. Once trench T has been prepared as desired, concrete may be poured therein.

Figure 12:
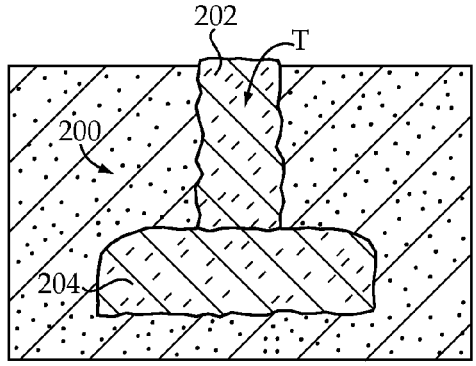
FIG. 12 is a sectioned view through a portion of a foundation system prepared according to the present disclosure.

Referring to FIG. 12, with trench T prepared as desired, a building foundation component 200 may be formed within trench T via pouring concrete into trench T, and intruding the poured concrete into the distal footing segment of the compound trench. In FIG. 12, reference numeral 204 denotes a poured concrete footing, whereas reference numeral 202 denotes a poured concrete stem of foundation component 200. Pouring foundation component 200 may take place in two pours, with each of footing 204 and stem 202 being formed by separate pours, and a compacting step performed in between the pouring steps. From the state depicted in FIG. 12, a building structure or the like can be built upon and supported by foundation component 200.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A digging system comprising:

a machine having a machine frame, ground engaging propulsion elements coupled with the machine frame, and a motor mounted to the machine frame and having a motor output shaft; and an implement assembly including an elongate boom having a proximal boom end pivotably coupled with the machine frame, a distal boom end, and a drive system having a drive wheel coupled with the motor output shaft and being positioned adjacent the proximal boom end, and a guide wheel mounted to the distal boom end, the drive wheel defining a first axis of rotation and the guide wheel defining a second axis of rotation;

the implement assembly further including a trenching mechanism having a plurality of drawing cutters coupled with an endless drive chain contacting and movable about each of the drive wheel and the guide wheel, and an undercutting mechanism mounted to the distal boom end and having a first rotating cutter projecting in a first axial direction from the distal boom end, and a second rotating cutter projecting in a second axial direction from the distal boom end;

an elongate shaft extending through the guide wheel from a first axial side to a second axial side thereof, the elongate shaft being fixed to rotate with the guide wheel, and each of the first and second rotating cutters being fixed to rotate with the elongate shaft, such that moving the endless drive chain about the drive wheel rotates the first and second rotating cutters;

the first axis of rotation and the second axis of rotation defining a plane, and the implement assembly further defining a compound projection profile in the plane, the compound projection profile including a proximal stem segment corresponding to the trenching mechanism, and a distal footing segment corresponding to the undercutting mechanism and adjoining the proximal stem segment;

the proximal stem segment including a relatively narrow segment width defined by outboard edges of the drawing cutters, and the distal footing segment including a relatively broad segment width defined by outboard ends of the first and second rotating cutters; and wherein each of the first and second rotating cutters tapers in diameter from a narrower diameter at axially outward locations to a broader diameter at axially inward locations.

2. The system of claim 1 further comprising a material directing drag mechanism coupled with the implement assembly and defining a drag profile in the plane, and the drag profile being congruous with the distal footing segment.

3. The digging system of claim 2 wherein the first and second rotating cutters include first and second co-rotating augers.

4. The digging system of claim 3 wherein the first and second co-rotating augers includes a left-handed auger and right-handed auger.

5. The digging system of claim 4 wherein the first and second co-rotating augers are fixed to rotate with the guide wheel.

6. The digging system of claim 5 wherein the undercutting mechanism includes a total of two rotating cutters.

7. The digging system of claim 2 wherein the material directing drag mechanism includes a drag plate, a yoke coupled with the drag plate, and a shock absorber coupled between the yoke and the implement assembly.

8. The digging system of claim 1 further comprising a finishing mechanism having first and second rotatable drums swappable with the first and second rotating cutters.

9. A method of preparing a foundation system comprising the steps of:

actuating a trenching mechanism of a digging system at least in part by moving a plurality of drawing cutters coupled with an endless drive chain about a proximal drive wheel, and a distal guide wheel defining an axis of rotation and being mounted to an elongate boom of an implement assembly;

rotating an elongate shaft extending through the distal guide wheel from a first axial side to a second axial side thereof, in response to actuating the trenching mechanism;

actuating an undercutting mechanism of the digging system at least in part by rotating a plurality of rotatable cutters projecting in opposite axial directions from a distal end of the elongate boom, in response to rotating the elongate shaft, each of the rotatable cutters tapering in diameter from a narrower diameter at axially outward locations to a broader diameter at axially inward locations; and simultaneously digging a narrow proximal stem segment and a broad distal footing segment of a compound trench at least in part by actuating the trenching mechanism and actuating the undercutting mechanism.

10. The method of claim 9 further comprising the steps of displacing material within the distal footing segment in an axially inward direction at least in part via actuating the undercutting mechanism, and displacing material within the proximal stem segment in a vertical direction oriented normal to an axis of rotation of the guide wheel at least in part via actuating the trenching mechanism.

11. The method of claim 10 further comprising a step of displacing material within the distal footing segment in a horizontal direction oriented normal to the axis of rotation at least in part by dragging a material directing drag mechanism along a floor of the distal footing segment.

12. The method of claim 11 further comprising a step of feeding material from a floor of the compound trench to an open ceiling of the compound trench according to a compound tri-directional feed path.

13. The method of claim 12 wherein each of the steps of actuating further includes actuating the trenching mechanism and actuating the undercutting mechanism during a step of performing a material removal pass with the digging system in a first assembly configuration, the method further comprising a step of performing a subsequent material finishing pass with the digging system in a second assembly configuration.

14. The method of claim 13 wherein:

the step of performing a material removal pass further includes performing the material removal pass with the material directing drag mechanism coupled with the implement assembly; and the step of performing a subsequent material finishing pass further includes a step of performing the subsequent material finishing pass with a set of rotatable finishing drums coupled with the implement assembly, and with the material directing drag mechanism and the plurality of rotating cutters decoupled from the implement assembly.

15. The method of claim 9 wherein the step of actuating the undercutting mechanism further includes co-rotating a first auger and a second auger together comprising the plurality of rotatable cutters.

16. The method of claim 13 further comprising a step of forming a building foundation component within the compound trench at least in part by way of the steps of pouring concrete into the compound trench, and intruding the poured concrete into the distal footing segment of the compound trench.

17. A digging system comprising:

a machine having a machine frame, ground engaging propulsion elements coupled with the machine frame, and a motor mounted to the machine frame and having a motor output shaft; and an implement assembly including an elongate boom having a proximal boom end pivotably coupled with the machine frame, a distal boom end, and a drive system having a drive wheel coupled with the motor output shaft and being positioned adjacent the proximal boom end, and a guide wheel mounted to the distal boom end, the drive wheel defining a first axis of rotation and the guide wheel defining a second axis of rotation;

the implement assembly further including a trenching mechanism having a plurality of drawing cutters coupled with an endless drive chain contacting and movable about each of the drive wheel and the guide wheel, and an undercutting mechanism mounted to the distal boom end and having a first rotating cutter projecting in a first axial direction from the distal boom end, and a second rotating cutter projecting in a second axial direction from the distal boom end;

an elongate shaft extending through the guide wheel from a first axial side to a second axial side thereof, the elongate shaft being fixed to rotate with the guide wheel, and each of the first and second rotating cutters being fixed to rotate with the elongate shaft, such that moving the endless drive chain about the drive wheel rotates the first and second rotating cutters;

the first axis of rotation and the second axis of rotation defining a plane, and the implement assembly further defining a compound projection profile in the plane, the compound projection profile including a proximal stem segment corresponding to the trenching mechanism, and a distal footing segment corresponding to the undercutting mechanism and adjoining the proximal stem segment; and the proximal stem segment including a relatively narrow segment width defined by outboard edges of the drawing cutters, and the distal footing segment including a relatively broad segment width defined by outboard ends of the first and second rotating cutters.

* * * * *